US006870151B2

(12) United States Patent
Kato

(10) Patent No.: US 6,870,151 B2
(45) Date of Patent: Mar. 22, 2005

(54) SHUTTER, OPTICAL SENSOR SYSTEM USING THE SAME AND SHUTTER HOLDER INCORPORATED THEREIN

(75) Inventor: Tadaharu Kato, Shizuoka-ken (JP)

(73) Assignee: Yamaha Corporation, Shizuoka (JP)

( * ) Notice: Subject to any disclaimer, the term of this patent is extended or adjusted under 35 U.S.C. 154(b) by 132 days.

(21) Appl. No.: 10/445,122

(22) Filed: May 23, 2003

(65) Prior Publication Data

US 2004/0065811 A1 Apr. 8, 2004

(30) Foreign Application Priority Data

May 30, 2002 (JP) ..... 2002-157230

(51) Int. Cl.[7] ..... G06M 7/00; G10H 1/32

(52) U.S. Cl. ..... 250/221; 250/227.22; 250/229; 84/724; 84/744

(58) Field of Search ..... 250/221, 222.1, 250/216, 227.21, 227.22, 229; 84/20, 723–725, 743–745; 385/12, 88–90

(56) References Cited

U.S. PATENT DOCUMENTS 6,407,321 B2 6/2002 Tamaki et al.
6,713,751 B2 * 3/2004 Muramatsu et al. ..... 250/221
6,815,603 B2 * 11/2004 Kato et al. ..... 84/744
2003/0025071 A1 2/2003 Kato et al.

FOREIGN PATENT DOCUMENTS

JP 3-154097 7/1991

* cited by examiner

*Primary Examiner*—Kevin Pyo
(74) *Attorney, Agent, or Firm*—Harness, Dickey & Pierce, P.L.C.

(57) ABSTRACT

A shutter holder has a frame-like base portion and a tie plate inwardly projecting from a side portion of the base portion in a cantilever fashion, and the tie plate has a rectangular cross section smaller in thickness and/or width, i.e., second moment of inertia than the cross section of the base plate at the boundary; even if a staple is deeply driven into a moving object such as a wooden key, the tie plate is widely deflected so as to absorb the deformation of the wooden key, and permits a shutter plate to keep itself perpendicular to the lower surface of the wooden key.

47 Claims, 9 Drawing Sheets

SHUTTER, OPTICAL SENSOR SYSTEM USING THE SAME AND SHUTTER HOLDER INCORPORATED THEREIN

FIELD OF THE INVENTION

This invention relates to an optical sensor system and, more particularly, to an optical sensor system for converting a current position of a moving object to an electric signal, a shutter incorporated in the optical sensor system for converting the current position of the moving object to an electric signal and a shutter holder forming a part of the shutter.

DESCRIPTION OF THE RELATED ART

The optical sensor system has found a wide variety of application field such as, for example, musical instruments. Acoustic musical instruments may not need any optical sensor system. However, the optical sensor systems are indispensable components of composite musical instruments as well as electric or electronic musical instruments. The composite musical instruments are compromises between the acoustic musical instruments and the electric or electronic musical instruments. Players finger the composite musical instruments as if they plays the corresponding acoustic musical instruments, and the build-in electric or electronic sound generators are responsive to the fingering on the composite musical instruments so as to generate electric or electronic tones.

The optical sensor system forms a part of the electric or electronic sound generator, and monitors the manipulators such as keys. While the player is fingering the composite musical instrument, the optical sensor system convert the motion of the manipulators to electric or electronic signals, and a data processing system produces an audio signal for the electric or electronic tones. Thus, the composite musical instruments require the optical sensor systems for producing the electric or electronic tones.

A typical example of the optical sensor system includes a light source, a light radiating head, a light receiving head and a light-to-electric signal converter. The light radiating head and light receiving head are provided on both sides of a trajectory on which the manipulator is moved. The light source and light-to-electric signal converter are usually connected through optical fibers to the light radiating head and light receiving head, respectively. The light source emits light, and the light is propagated through the optical fiber to the light radiating head. The light is radiated from the light radiating head across the trajectory, and is incident on the light receiving head. The incident light is propagated from the light receiving head through the optical fiber to the light-to-electric signal converter. The incident light is converted to the electric signal by means of the light-to-electric signal converter. While the manipulator is traveling on the trajectory, a physical quantity of light is varied depending upon the current position of the manipulator, and the light-to-electric signal converter varies the electric current depending upon the physical quantity.

If the manipulators had a shape optimum for varying the physical quantity, they would directly vary the physical quantity of the light. Although the manipulators are designed to be optimum for fingering, the manufacturers do not take the optical system into account. For this reason, shutters are usually attached to the manipulators, and the optical sensor system indirectly varies the current positions of the manipulators to the physical quantity of light through the shutters.

Typical examples of the shutter are disclosed in Japan Patent Application laid-open No. hei 3-154097 and Japan Patent Application laid-open No. 2001-195071. In the prior art optical sensor systems, the amount of light is the physical quantity. Japan Patent Application No. 2000-001080 was published as Japan Patent Application laid-open No. 2001-195071, and offered the convention priority right to U.S. Ser. No. 09/754,780, which has already resulted in U.S. Pat. No. 6,407,321 B2. The prior art shutter disclosed in Japan Patent Application laid-open No. hei 3-154097 is hereinafter referred to "first prior art shutter", and the prior art disclosed in the other Japan Patent Application laid-open is referred to as "second prior art shutter".

Although different assembling methods are disclosed in Japan Patent Application laid-open Nos. hei 3-154097 and 2001-195071, the first prior art shutter has a shape analogous to that of the second prior art shutter. The first prior art shutter and second prior art shutter are made of metal, and have shapes like a short angle bar, i.e., two flat portions crossing at right angle. One of the two flat portions serves as a base to be secured to a lower surface of a wooden key, and the other flat portion serves as an interrupter. A pair of holes is formed in the base, and a staple or a pair of staples is driven into the wooden key through the pair of holes. In other words, the first prior art shutter is secured to the key by means of the staple or pair of staples, and the interrupter downwardly projects from the lower surface of the wooden key.

Although a tool for the staples is not clearly taught in Japan Patent Application laid-open No. hei 3-154097, a stapler is available for the staples. The stapler has a magazine and a puncher, and the magazine is formed with a slot. Staples are stored in the magazine, and each staple is moved into the slot. The puncher exerts force on the staple so that the staple projects from the magazine through the slot. When the staple is driven into the wooden key, the stapler is aligned with the hole or holes, and the staple is pushed into the wooden key by means of the puncher.

Another shutter was taught in Japan Patent Application No. 2001-232455, which offered the convention priority right to U.S. Ser. No. 10/199,256. U.S. Ser. No. 10/199,256 was published as U.S. 2003/0025071 A1. However, the priority date of the present patent application is earlier than the publication date of U.S. 2003/0025071 as well as than the publication date of the Japan Application laid-open. The shutter has an elastic coupler, from which an optical filter is hung. The elastic coupler has an expander, which is like claws of a crab. When force is exerted on the expander, the claws get close to each other, and, accordingly, reduce the width of the expander. A recess is formed in the key, and the expander is inserted into the recess. The force is removed from the claws. Then, the claws expand, and are pressed to the inner surface defining the recess.

A problem is encountered in the first and second prior art shutters in that the interrupters irregularly project from the lower surfaces of the keys. In other words, the first and second shutters have different attitudes under the keys. The irregularity of the interrupters is causative of difference in the amount of light received at the light receiving heads, and strict calibration is required for the prior art optical sensor systems. This results in increase of the installation cost.

The shutter proposed in Japan Patent Application No. 2001-232455 is free from the problem inherent in the first and second prior art shutters. However, it is necessary to form the recess in each of the key. The manufacturer machines the keys for forming the recesses, and the machining makes the installation cost increased. In case where the optical sensor system is installed in the piano after the delivery to the user, it is difficult to precisely form the recesses in the keys at user's home. Thus, the optical sensor system disclosed in the Japan Patent Application has the application field narrower than those of the first and second prior art shutters.

SUMMARY OF THE INVENTION

It is therefore an important object of the present invention to provide a shutter, which is secured to a moving object in a designed attitude.

It is also an important object of the present invention to provide an optical sensor system, which includes the shutter.

The present inventor investigated the first/second prior art shutters, and found the base plates to be differently strained. The present inventor further investigated the cause of the strain, and noticed that the puncher tended to overshoot the staples. If the puncher stopped just on the surface of the base plate, the base plate would be not strained. However, the stroke of the puncher was not strictly controlled. The puncher was brought into collision against the base plate, and made the base plate strained. When the base plates were made of synthetic resin, the base plates were liable to be broken. Then, the assembling worker extracted the staples from the keys, changed the broken shutter to a new one, and drove staples into the key, again. It was difficult to precisely control the stroke of the puncher. The present inventor concluded that the strain did not have influence on the interrupters.

To accomplish the object, the present invention proposes to prohibit the influence of the deformation of a moving object to reach a coupling portion.

In accordance with one aspect of the present invention, there is provided a shutter secured to a moving object made of a first material comprising a shutter plate crossing a light beam in a motion of the moving object, and a shutter holder including a base portion made of a second material and formed with a hollow space through which a fixing member made of a third material harder than the first and second materials is driven into the moving object for securing the shutter holder to the moving object, a coupling portion formed at a first sub-portion of the base portion and connected to the shutter plate so as to keep the shutter plate in a predetermined attitude with respect to the moving object and a tie portion projecting from a second portion of the base portion into the hollow space, pressed to the moving object by means of the fixing member and having a small flexural rigidity for absorbing a deformation of the moving object due to the fixing member excessively driven thereinto without changing the attitude of the shutter plate.

In accordance with another aspect of the present invention, there is provided a shutter secured to a moving object made of a first material comprising a shutter plate crossing a light beam in a motion of the moving object, and a shutter holder including a base portion made of a second material and formed with a hollow space through which a fixing member made of a third material harder than the first and second materials is driven into the moving object for securing the shutter holder to the moving object, a coupling portion formed at a first sub-portion of the base portion and connected to the shutter plate so as to keep the shutter plate in a predetermined attitude with respect to the moving object and a tie portion projecting from a second sub-portion of the base portion into the hollow space in a cantilever fashion and pressed to the moving object by means of the fixing member, the first sub-portion being spaced from the second sub-portion.

In accordance with yet another aspect of the present invention, there is provided an optical sensor system for converting current positions of moving objects made of a first material to electric signals comprising an optical sub-system producing light beams across trajectories of the moving objects and converting the amount of light of the light beams to the electric signals and shutters respectively connected to the moving objects so as to travel on the trajectories together with the moving objects, and each of the shutters includes a shutter plate crossing associated one of the trajectories and a shutter holder having a base portion made of a second material and formed with a hollow space through which a fixing member made of a third material harder than the first and second materials is driven into the moving object for securing the shutter holder to the moving object, a coupling portion formed at a first sub-portion of the base portion and connected to the shutter plate so as to keep the shutter plate in a predetermined attitude with respect to associated one of the moving objects and a tie portion projecting from a second portion of the base portion into the hollow space, pressed to the associated one of the moving objects by means of the fixing member and having a small flexural rigidity for absorbing a deformation of the associated one of the moving objects due to the fixing member excessively driven thereinto without changing the attitude of the shutter plate.

In accordance with still another aspect of the present invention, there is provided an optical sensor system for converting current positions of moving objects made of a first material to electric signals comprising an optical sub-system producing light beams across trajectories of the moving objects and converting the amount of light of the light beams to the electric signals and shutters respectively connected to the moving objects so as to travel on the trajectories together with the moving objects, each of the shutters includes a shutter plate crossing associated one of the trajectories and a shutter holder having a base portion made of a second material and formed with a hollow space through which a fixing member made of a third material harder than the first and second materials is driven into the moving object for securing the shutter holder to the moving object, a coupling portion formed at a first sub-portion of the base portion and connected to the shutter plate so as to keep the shutter plate in a predetermined attitude with respect to associated one of the moving objects and a tie portion projecting from a second sub-portion of the base portion into the hollow space in a cantilever fashion and pressed to the moving object by means of the fixing member, and the first sub-portion is spaced from the second sub-portion.

In accordance with yet another aspect of the present invention, there is provided a shutter holder for keeping a member stable with respect to an object made of a first material comprising a base portion made of a second material and formed with a hollow space through which a fixing member made of a third material harder than the first and second materials is driven into the object for securing the shutter holder to the object, a coupling portion formed at a first sub-portion of the base portion and connected to the member so as to keep the member in a predetermined attitude with respect to the object, and a tie portion projecting from a second sub-portion of the base portion into the hollow space, pressed to the object by means of the fixing member and having a small flexural rigidity for absorbing a deformation of the object due to the fixing member excessively driven thereinto without changing the attitude of the member.

In accordance with still another aspect of the present invention, there is provided a shutter holder for keeping a member stable with respect to an object made of a first material comprising a base portion made of a second material and formed with a hollow space through which a fixing member made of a third material harder than the first and second materials is driven into the object for securing the shutter holder to the object, a coupling portion formed at a first sub-portion of the base portion and connected to the shutter plate so as to keep the shutter plate in a predetermined attitude with respect to the object and a tie portion projecting from a second sub-portion of the base portion into the hollow space in a cantilever fashion and pressed to the object by means of the fixing member, and the first sub-portion is spaced from the second sub-portion.

BRIEF DESCRIPTION OF THE DRAWINGS

The features and advantages of the shutter and optical sensor system will be more clearly understood from the following description taken in conjunction with the accompanying drawings, in which.

DESCRIPTION OF THE PREFERRED EMBODIMENTS

There are two approaches in order to prohibit deformation of a key from reaching a coupling portion. A shutter embodying the present invention largely comprises a shutter plate and a shutter holder. The holder is imaginarily broken down into a base portion, a tie portion and a coupling portion. The base portion is formed with a hollow space. The tie portion projects from the base portion into the hollow space in a cantilever fashion, and a staple presses the tie portion to a key, by way of example. As a result, the shutter holder is secured to a contact surface of the key. The portion from which the tie portion projects is hereinafter referred to as "boundary portion". The coupling portion is formed on the base portion, and keeps the shutter plate perpendicular to the contact surface. The staple is driven into the key through the hollow space, and is brought into contact with the tie portion. If the force is continuously exerted on the staple after the contact between the staple and the tie portion, the staple is sunk into the key, and makes the key plastically deformed, and causes the shutter holder and, accordingly, shutter plate to change the attitude, i.e., incline.

The first approach is to absorb the deformation of the key through deflection of the tie portion. The smaller the flexural rigidity is, the wider the deflection is. The tie portion is designed to have the flexural rigidity large enough to absorb the deformation of the key through the deflection thereof. If the tie portion is equal to or greater in flexural rigidity than the boundary portion, the base portion is deformed due to the bending moment, and the deformed base portion makes the coupling portion inclined. Thus, the flexural rigidity smaller than that of the base portion is an indispensable feature of the shutter holder according to one aspect of the present invention. However, a cantilever is not the indispensable feature. The tie portion may be connected at both ends thereof to the base portion.

The second approach is to provide the base portion between the tie portion and the coupling portion. When the bending moment is exerted on the tie portion, the bending moment is transmitted from the tie portion through the base portion to the coupling portion. The bending moment transmission path is long enough to absorb the deformation of the key. This means that the bending moment is never directly transmitted from the tie portion to the coupling portion. The deformation of the key is absorbed through the deflection of the tie portion and/or deformation of the base portion. Only the base portion may be deformed. Thus, the disconnection between the tie portion and the coupling portion is the indispensable feature from the aspect of the second approach. However, the small flexural rigidity of the tie portion is not the indispensable feature.

First Embodiment

Figure 1:
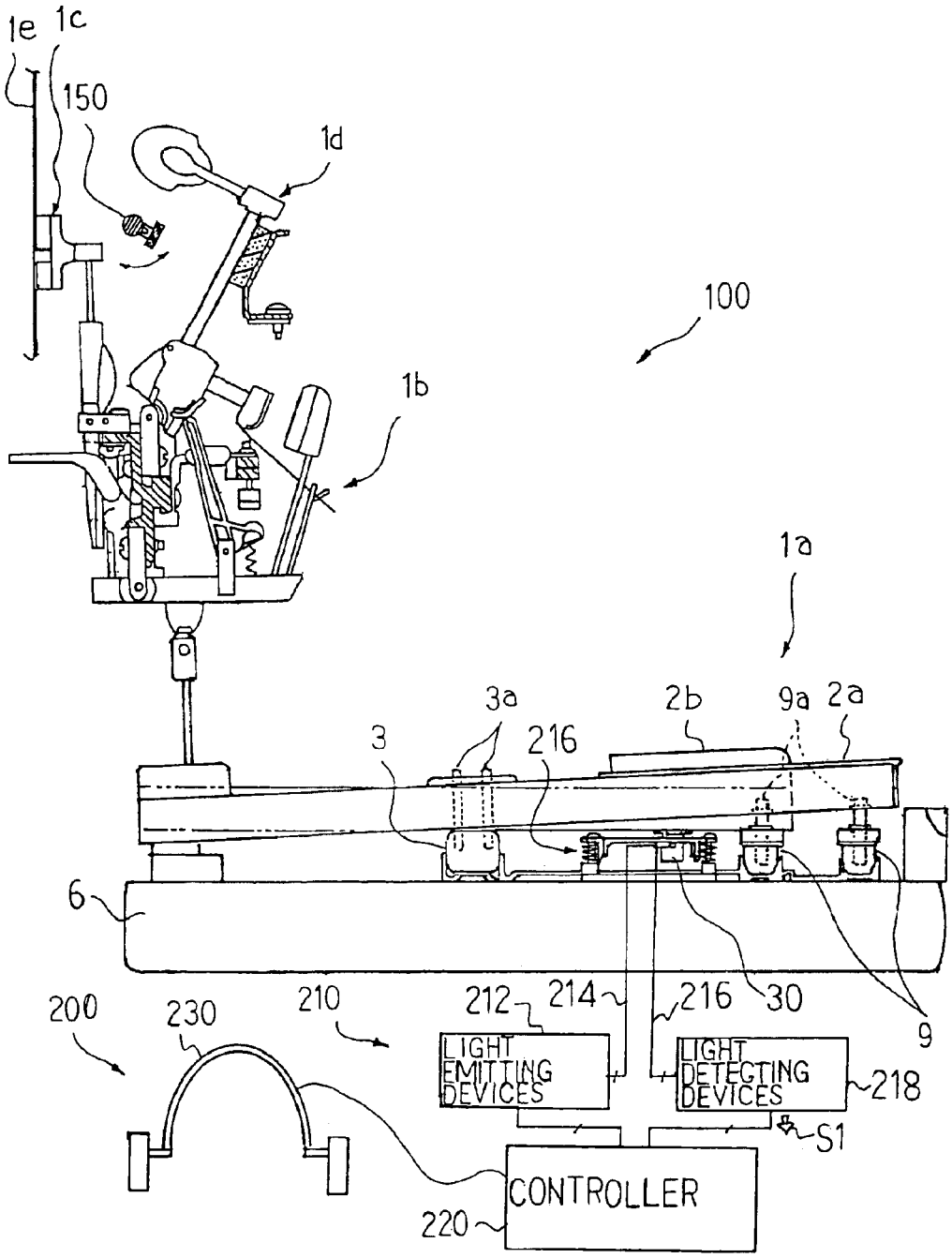
FIG. 1 is a schematic side view showing the structure of a composite keyboard musical instrument according to the present invention.

Referring to FIG. 1 of the drawings, a composite keyboard musical instrument embodying the present invention largely comprises an acoustic piano 100, a hammer stopper 150 and an electronic sound generating system 200. In this instance, the acoustic piano 100 is same as a standard upright piano. However, a grand piano may be used as the acoustic piano 100. The hammer stopper 150 is changed between a free position and a blocking position. The hammer stopper 150 at the free position is not any obstacle against the acoustic piano 100, and a pianist can perform a piece of music through acoustic piano tones. On the other hand, the hammer stopper 150 at the blocking position does not permit the acoustic piano to generate the acoustic piano tones in response to the fingering, and the electronic sound generating system 200 generates electronic tones instead of the acoustic piano tones. Thus, the player can selectively perform pieces of music through either electronic or acoustic tones.

In the following description, term "front" modifies a position closer to the player, who is fingering on the acoustic piano, than a position modified with term "rear", and is corresponding to the right side of the paper where FIG. 1 is drawn. A line between a front position and a corresponding rear position extends in a "fore-and-aft direction", and a lateral direction crosses the fore-and-aft direction at right angle.

The acoustic piano 100 includes a keyboard 1*a*, action units 1*b*, damper units 1*c*, hammers 1*d* and strings 1*e*. The keyboard 1*a* is mounted on a key bed 6, which forms a part of a piano case. The action units 1*b*, damper units 1*c*, hammers 1*d* and strings 1*e* are housed in the piano case. However, other boards of the piano case are removed so as to show the other components 1*b*/1*c*/1*d* and 1*e*. White keys 2*a* and black keys 2*b* form the keyboard 1*a*, and are rotatably put on a balance rail 3. In detail, balance pins 3*a* are upright on the balance rail 3, and restrict the associated white/black keys 2*a*/2*b* to the bi-directional rotation. Front rails 9 laterally extend under the front portions of the white/black keys 2*a*/2*b*, and front rails 9*a* are upright on the front rails 9. The front pins 9*a* restrict the associated white/black keys 2*a*/2*b* to the bi-directional rotation, and do not permit the white/black keys 2*a*/2*b* from the sideslip. Thus, the front pins 9*a* and balance pins 3*a* guide the associated white/black keys 2*a*/2*b* to target trajectories for the rotation.

The black/white keys 2*a*/2*b* are linked at the rear end portions with the action units 1*b*, respectively, so that the player selectively actuates the action units by depressing the associated black/white keys 2*a*/2*b*. The action units 1*b* are linked with the damper units 1*c* and hammers 1*d*. The actuated action units 1*b* make the associated damper units 1*c* spaced from the strings 1*e*, and drive the associated hammers for rotation. While the player is depressing the white/black keys 2*a*/2*b*, the action units 1*b* and hammers 1*d* give the resistance against the key motion, and the player feels the white/black keys 2*a*/2*b* heavy. When the hammers 1*d* escape from the associated action units 1*b*, the hammers 1*d* start the free rotation, and only the action units 1*b* give the resistance against the key motion. The player feels the white/black keys 2*a*/2*b* light. Thus, the action units 1*b* and hammers 1*d* give unique key touch to the player.

The hammer stopper 150 laterally extends in the space between the strings 1*e* and hammers 1*d*. The hammers 1*d* rebound on the hammer stopper 150 at the blocking position on the way toward the strings 1*e*, and the strings 1*e* do not vibrate. However, the hammers 1*d* escape from the associated action units 1*b*, and the player feels the unique key touch at his or her fingers. On the other hand, the hammers 1*d* strike the strings 1*e* without any interruption of the hammer stopper 150 at the free position so that the strings 1*e* vibrate for generating the acoustic piano tones. Thus, the hammers 1*d* differently behaves depending upon the current position of the hammer stopper 1*d*.

The electronic sound generating system 200 includes an optical sensor system 210, a controller 220 and a headphone 230. A loud speaker or speakers may be connected to the controller 220. The optical sensor system 210 monitors the white/black keys 2*a*/2*b*, and produces key position signals S1 representative of the current key positions on the trajectories. The key position signals S1 are supplied from the optical sensor system 210 to the controller 220. The controller periodically checks the current key positions to see whether or not the player depresses any one of the white/black keys 2*a*/2*b*. If the white/black keys 2*a*/2*b* keep the current key positions unchanged, the controller 220 make a decision that the player does not depress the white/black keys 2*a*/2*b*. On the other hand, when the controller 220 finds a white/black key 2*a*/2*b* to change the current key position, the controller 220 specifies the black/white key 2*a*/2*b*, and calculates the key velocity. The controller 220 produces music data codes representative of the key code, key velocity and note-on/note-off event, and reads out pieces of waveform data from an internal memory. The pieces of waveform data are converted to an analog audio signal, and the analog audio signal is supplied to the headphone 230 for generating the electronic tones.

The optical sensor system 210 includes light emitting devices 212, optical fibers 214, an array 216 of light radiating sensor heads and light receiving sensor heads, shutters 30, optical fibers 216 and light detecting devices 218. The controller 220 is connected to the light emitting devices 212, and sequentially periodically energizes the light emitting devices 212 so that the light emitting devices 212 emit the light. The light emitting devices 212 are connected through the optical fibers 214 to the array 11 of light radiating sensor heads and light receiving sensor heads, and the light is propagated to the light radiating sensor heads 11*a* (see FIG. 2). The light radiating sensor heads 11*a* are alternated with the light receiving sensor heads 11*b*, and are laterally spaced therefrom. The light beams are laterally radiated from the light radiating sensor heads 11*a*, and are incident onto the associated light receiving sensor heads 11*b*. The shutters 30 are respectively secured to the lower surfaces of the white/black keys 2*a*/2*b*, and are moved along target trajectories. The light beams extend across the target trajectories of the shutters 30 so that the shutters 30 interrupt the associated light beams. The array 11 in turn is connected through the optical fibers 216 to the light detecting devices 218, and the incident light is propagated from the light receiving sensor heads 11*b* to the light detecting devices 218. The light detecting devices 218 convert the incident light to photo current. The light detecting devices 218 is further connected to the controller 218, and supplies the key position signals S1, which are produced from the photo current, to the controller 220.

Figure 2:
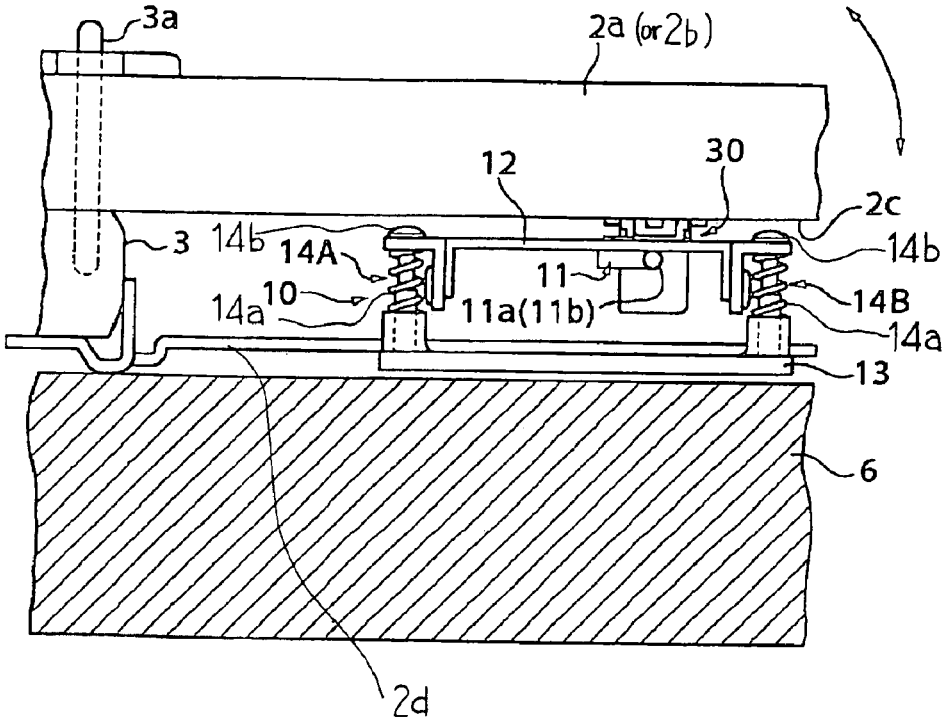
FIG. 2 is a side view showing the structure of an optical sensor system incorporated in the composite keyboard musical instrument.

As will be better seen in FIG. 2, the array 11 of light radiating sensor heads 11*a* and light receiving sensor heads 11*b* form an optical sensor unit 10 together with a top plate 12, a base plate 13 and adjustable spacers 14A/14B. The shutters 30 are respectively secured to the lower surfaces 2*c* of the white/black keys 2*a*/2*b* so as to be arranged in the lateral direction. The base plate 13 is secured to a key frame 2*d*, which forms a part of the keyboard 1*a*. The top plate 12 is formed with slits, and the slits are spaced from one another by a distance equal to the distance between the shutters 30. The light radiating sensor heads 11*a* and light receiving sensor heads 11*b* are alternately secured to the lower surface of the top plate 12, and each light receiving sensor head 11*b* and associated light radiating sensor head 11*a* are on both sides of associated one of the slits. For this reason, the light beam extends in the space under the slit. The top plate 12 is assembled with the base plate 13 in such a manner that the slits are aligned with the associated shutters 30, and the adjustable spacers 14A/14B are provided between the base plate 13 and the top plate 12. In other words, the top plate 12 is supported by the base plate 13 through the adjustable spacers 14A/14B, and the trajectories of shutters 30 pass through the associated slits, respectively. Thus, the light beams extend across the trajectories of the associated shutters 30.

Each of the adjustable spacers 14A/14B includes a coil spring 14*a* and a screw 14*b*. Female screws are formed in the base plate, and the screws 14*b* are engaged with the female screws. The coil springs 14*a* are provided between the base-plate 13 and the heads of the screws 14*b*, and are compressed for supporting the top plate 12. When the screws 14*b* are driven into the base plate 13, the coil springs 14*a* are further compressed, and the top plate 12 and, accordingly, the array 11 get closer to the base plate 13. On the other hand, when the screws 14*b* are loosened, the coil springs 14*a* expand, and push the top plate 12 upwardly. This results in that the top plate 12 and, accordingly, the array 11 are further spaced from the base plate 13. Thus, the array 11 is adjusted to an appropriate height by using the adjustable spacers 14A/14B.

Figure 3:
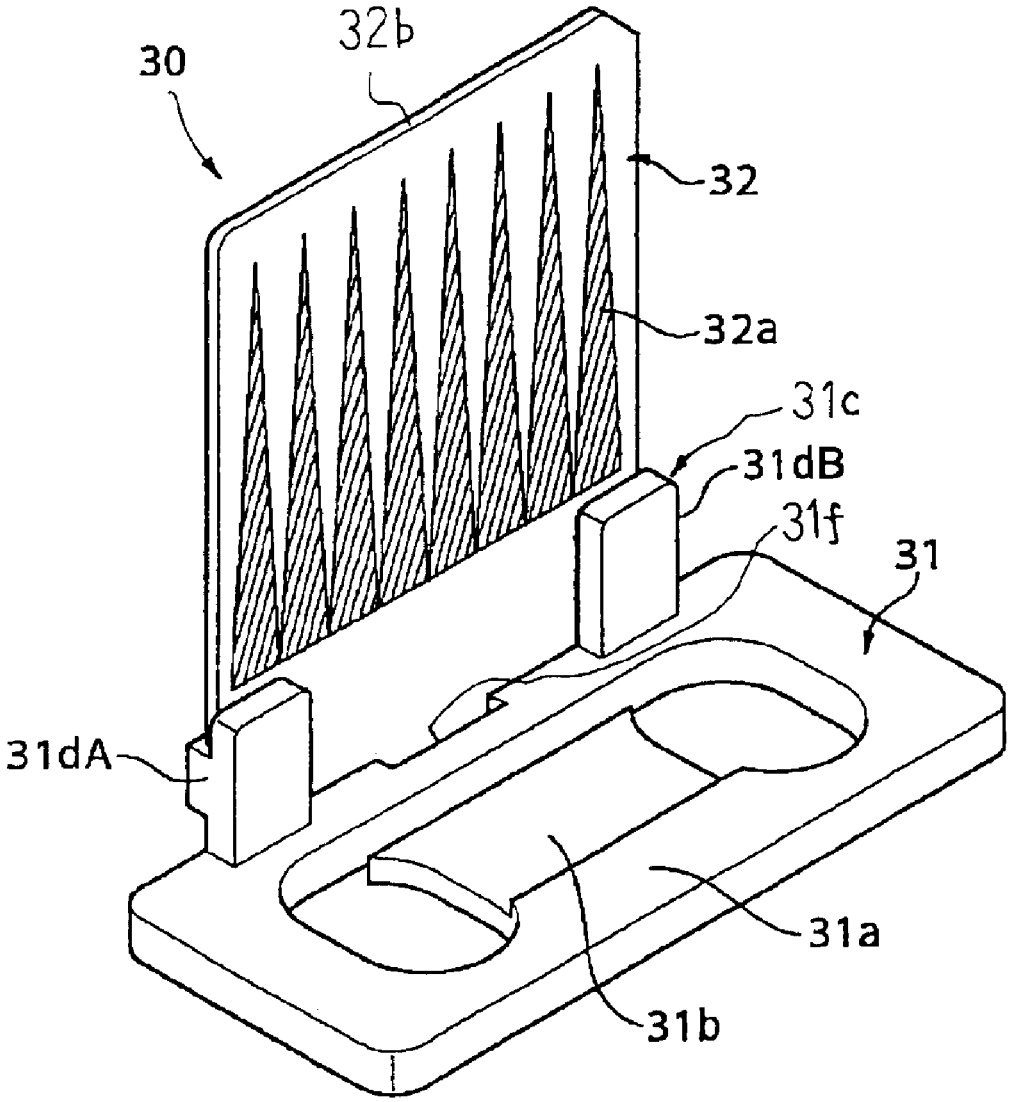
FIG. 3 is a perspective view showing the structure of a shutter incorporated in the optical sensor system.

Turning to FIG. 3 of the drawings, the shutter 30 is broken down into a shutter holder 31 and a shutter plate 32. The shutter 30 is designed from the aspects of both approaches.

The sensor holder 31 is secured to the associated white/black key 2*a*/2*b* by means of a staple, and the shutter plate 32 is attached to the sensor holder 31. Although the shutter plate 32 upwardly projects from the shutter holder 31 in FIG. 3, the shutter holder 31 is inverted, and is secured to the lower surface 2*c* of the associated white/black key 2*a*/2*b*. For this reason, the shutter plate 32 is hung from the shutter holder 31.

The shutter plate 32 is made from a film of transparent resilient material such as, for example, PET (Poly-Ethylene Terephthalate), and is in the form of a sheet of synthetic resin film. The shutter plate 32 has a pair of rectangular major surfaces. A saw-tooth pattern 32*a* is printed on the major surface or surfaces. The saw-tooth pattern 32 is indicative of hatching lines in FIG. 3. The saw-tooth pattern 32*a* is non-transparent. In this instance, the saw-tooth pattern 32*a* is colored in black. The ratio between the transparent area and the non-transparent area is varied toward the end surface 32*b* of the shutter plate 32. While the shutter 30 is being moved together with the associated key 2*a*/2*b*, the light beam is incident on the major surface at right angle, and partially passes through the shutter plate 32. The area of the transparent portion where the light beam passes is varied during the downward motion of the shutter plate 32. This means that the amount of light incident on the associated light receiving sensor head 11*b* is varied depending upon the current key position. For this reason, the controller 220 can determine the stroke over which the key 2*a*/2*b* is moved.

Figure 4A:
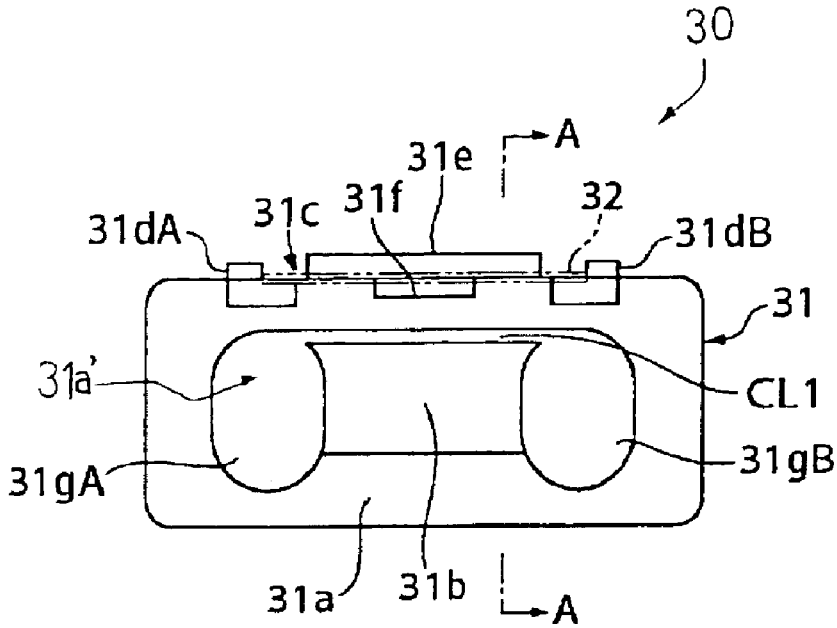
FIG. 4A is plane view showing a shutter holder forming a part of the shutter.
Figure 4B:
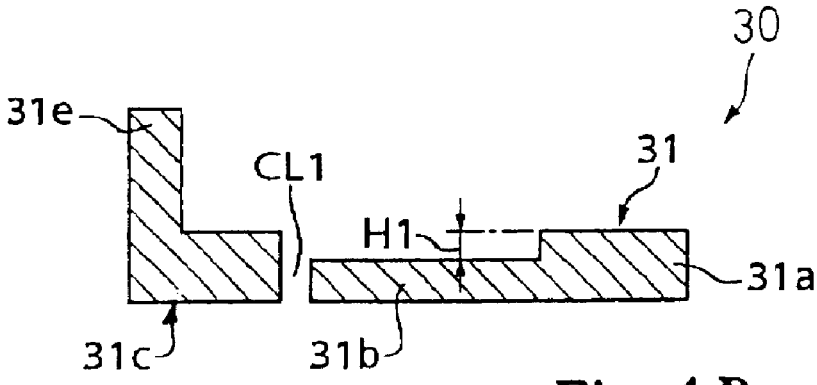
FIG. 4B is a cross sectional view taken along line A—A of FIG. 4A, FIGS. 5A to 5C are schematic cross sectional views showing a method for assembling a shutter with a key.

The shutter holder 31 is made of synthetic resin such as, for example, polyacetal or nylon. As will be better seen in FIGS. 4A and 4B, the shutter holder 31 has a base portion 31*a*, a tie plate 31*b* and a coupling portion 31*c*. The base portion 31*a*, tie plate 31*b* and coupling portion 31*c* are monolithic. The coupling portion 31*c* is perpendicular to the base portion 31*a*, and retains the shutter plate 32. On the other hand, the tie plate 31*b* is pressed to the lower surface 2*c* of the associated white/black key 2*a*/2*b* by means of a staple so that the base portion 31*a* is held in contact with the lower surface 2*c*. Thus, the shutter holder 31 is assembled with the white/black key 2*a*/2*b* by means of the staple. When the shutter holder 31 is secured to the lower surface 2*c*, the shutter plate 32 is hung from the shutter holder 31, and is never dropped during the key motion.

The base portion 31*a* is formed with a hole 31*a*', and the tie plate 31*b* projects from a side surface of the base portion 31*a* into the hole 31*a*'. The tie plate 31*b* does not reach the other side surface, and a gap CL1 takes place between the tie plate 31*b* and the other side surface. In other words, the tile plate 31*b* is a cantilever. The tie plate 31*b* is thinner than the base portion 31*a*, and the difference H1 in thickness between the tie plate 31*b* and the base portion 31*a* is approximately equal to the thickness of the staple. Thus, the tie plate 31*b* is much more deformable than the base plate 31*a*.

The tie plate 31*b* defines two hollow spaces 31*g*A/31*g*B together with the base plate 31*a*, and the hollow spaces 31*g*A/31*g*B are on both sides of the tie plate 31*b*. The hollow spaces 31*g*A/31*g*B are wide enough to permit the staple to pass therethrough. When the staple is driven into the white/black key 2*a*/2*b* through the shutter holder 31, the staple presses the time plate 31*b* to the lower surface 2*c*, and retains the shutter holder 31 on the lower surface 2*c*. Strong force is assumed to be exerted on the staple. The strong force makes the staple sunk into the white/black key 2*a*/2*b*, and the white/black key 2*a*/2*b* is plastically deformed. This means that the tie plate 31*b* is warped. However, the base portion 31*a* is never deformed, because the tie plate 31*b* takes up the displacement of the white/black key 2*a*/2*b*. As a result, the base portion 31*a* keeps the coupling portion 31*c* in the initial attitude after the assembling work.

A back wall 31*e*, a pair of edge blocks 31*d*A/31*d*B and a part of the base portion 31*a* defining a dent 31*f* form in combination the coupling portion 31*c*. An extremely narrow clearance is formed between the back wall 31*e* and the edge blocks 31*d*A/31*d*B, and the width of the clearance is approximately equal to the thickness of the shutter plate 32. The shutter plate 32 has a projection, which is as wide as the dent 31*f*. The projection is inserted into the dent 31*f*, and the shutter plate 32 is snugly received in the extremely narrow clearance. The friction therebetween and the resiliency of the shutter plate 32 keep the shutter plate 32 in the clearance. The assembling worker is expected to insert the shutter plate 32 into the coupling portion 31*c*, and feels the assembling easy.

Figure 5A:
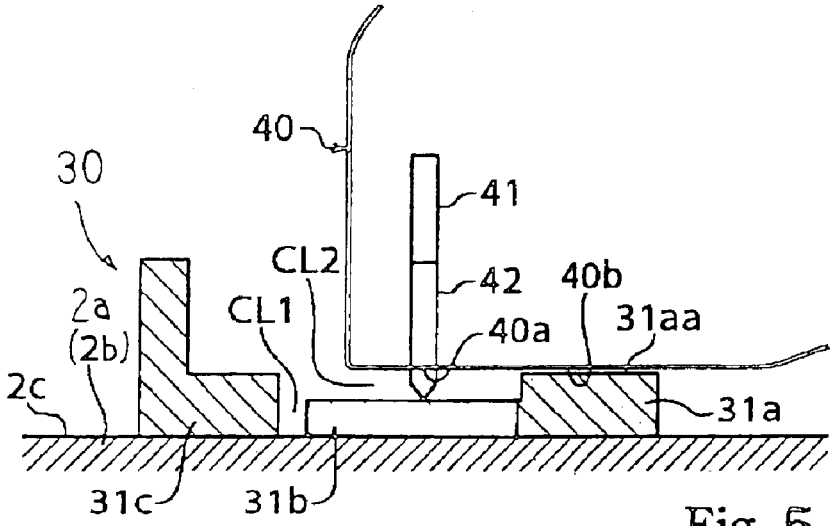
Figure 5B:
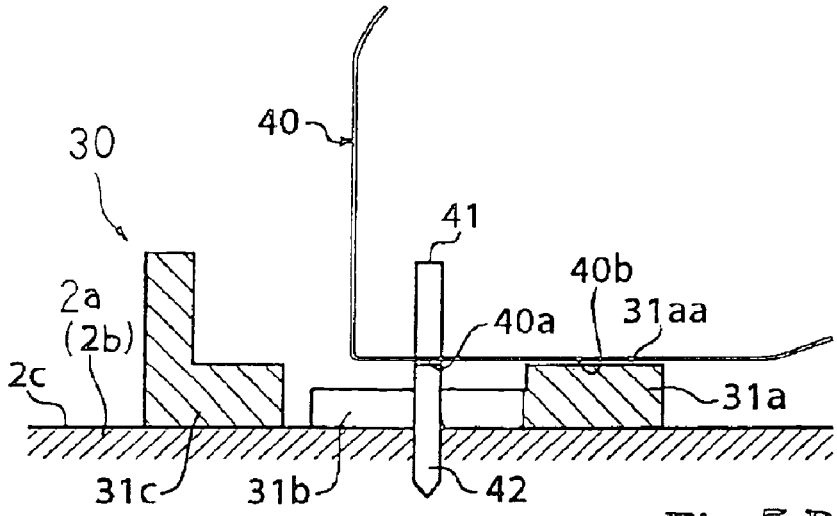
Figure 5C:
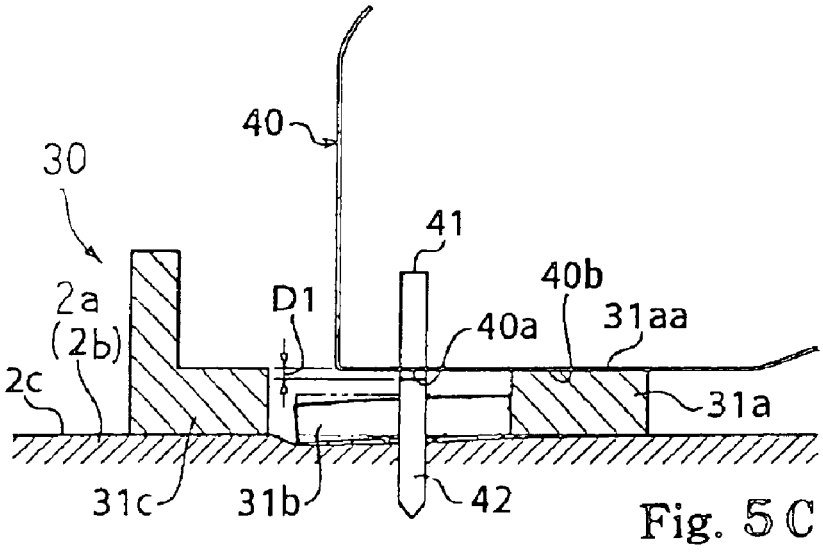

The shutter 30 is assembled with the white/black key 2*a*/2*b* as follows. FIGS. 5A to 5C show a method for assembling the shutter 30 with the white/black key 2*a*/2*b*. The shutter plate 32 may have been assembled with the shutter holder 31. However, the shutter plate 32 is not shown in FIGS. 5A to 5C. Otherwise, the shutter plate 32 will be assembled with the shutter holder 31 after the assemblage through the method shown in FIGS. 5A to 5C.

Figure 6:
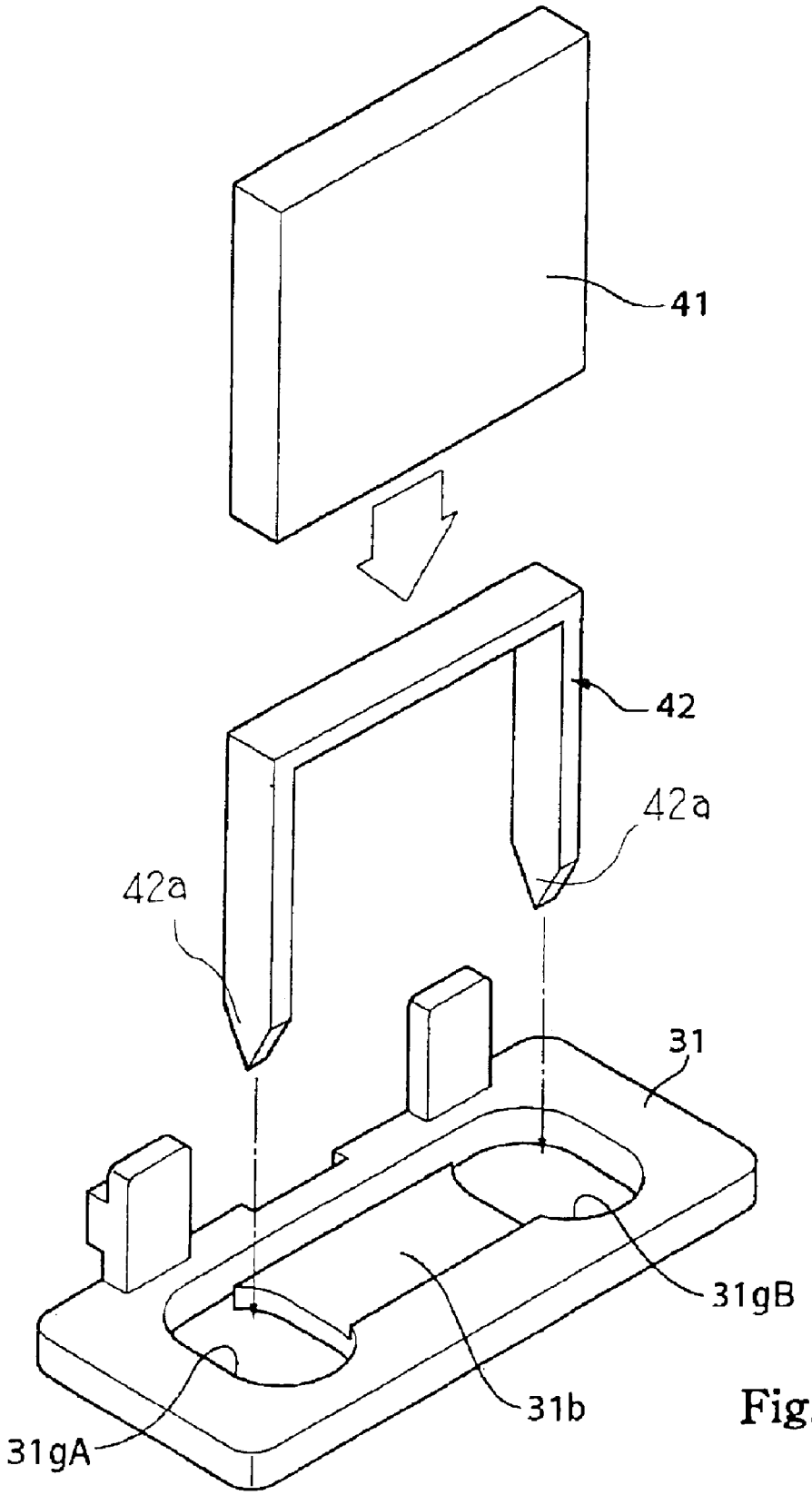
FIG. 6 is a fragmentary perspective view showing a stapler over a tie plate of the shutter.

First, the white/black key 2*a*/2*b*, shutter 30 and a stapler 40 are prepared on a working bench (not shown). The stapler 40 is formed with a slit 40*a*, and has a puncher 41. A staple 42 has a pair of tips 42*a*, and the tips 42*a* project from an intermediate portion 42*b* as shown in FIG. 6. The staple 42 is made of metal or alloy such as, for example, steel. The staple 42 is moved into the slit 40*a*, and tips 42*a* of the stapler 42 slightly project from the slit 40*a*.

Subsequently, an assembling worker turns the white/black key 2*a*/2*b* over, and puts it on the working bench. The lower surface 2*c* is directed upwardly. The stapler 40 is moved onto the lower surface 2*c*, and the tips 42*a* of the stapler 42 are aligned with the hollow spaces 31*g*A/31*g*B, respectively. The intermediate portion 40*b* extends over the tie plate 31*b*. The stapler 40 is moved downwardly, and the lower surface 40*b* of the stapler 40 is brought into contact with the base portion 31*a* as shown in FIG. 5A. Since the lower surface 40*b* is flat, the slit 40*a* is spaced from the tie plate 40*b*, and the tips slightly project into the hollow spaces 31*g*A/31*g*B, respectively. The gap CL2 between the lower surface 40*b* and the tie plate 31*b* is approximately equal to the difference H1.

Subsequently, the puncher 41 is moved downwardly. The puncher exerts force on the stapler 42, and the tips 40*a* are driven into the white/black key 2*a*/2*b* through the hollow spaces 31*g*A/31*g*B as shown in FIG. 5B.

The intermediate portion 40*b* is brought into contact with the tie plate 31*b*. However, the puncher 41 further exerts the force on the staple 42 so that the staple 42 resiliently warps the tie plate 31*b*. The tie plate 31*b* is so flexible that the tie plate 31*b* absorbs the overshoot D1 without serious influence on the base portion 31*a* and, accordingly, the coupling portion 31*c*. In this instance, the overshoot is of the order of 0.3 millimeter, and the tie plate 31*b* is 6.0 millimeters in length, 3.45 millimeters in width and 0.5 millimeter in thickness. The force is transmitted through the tie plate 31*b* to the white/black key 2*a*/2*b*, and makes the white/black key 2*a*/2*b* plastically deformed as shown in FIG. 5C.

As will be understood from the foregoing description, the tie plate 31*b* is thinner than the base portion 31*a*. This is because of the fact the flexural rigidity of the tie plate 31*b* is smaller than that of the base portion 31*a*. In this instance, the tie plate 31*b* and base portion 31*a* are monolithic, and, accordingly, are made of the same synthetic resin. The smaller the second moment of inertia is, the smaller the flexural rigidity is. The tie plate 31*b* is designed in such a manner as to have the flexural rigidity small enough to absorb the deflection due to the overshoot in the assembling. For this reason, the base plate 31*a* is less deformed, and, accordingly, the permit the coupling portion 31*c* to keep itself perpendicular thereto. Since the tie plate has the flexural rigidity, which is small enough to make the tie plate deflected for absorbing the plastic deformation of the white/black key 2*a*/2*b*, the shutter plates 32 are attached to the white/black keys 2*a*/2*b* in the appropriate attitude. Even if the shutter holder 31 is made of metal or alloy, the tie plate 31*b* is effective against the inclination of the shutter plate 32. The tie plate 31*b* has the indispensable feature from the aspect of the first approach.

The tie plate 31*b* projects from the base portion 31*a* in the cantilever fashion, and the coupling portion 31*c* is formed on the opposite side. In other words, the tie portion 31*b* is faced to the other side through the gap CL1. For this reason, the bending moment is never directly transmitted to the coupling portion 31*c*. Even if the bending moment makes the base portion 31*a* slightly deformed, the deformed base plate 31*a* does not have any serious influence on the attitude of the coupling portion 31*c*. Thus, the shutter holder 31 has the indispensable feature from the aspect of the second approach.

Moreover, the tie plate 31*b* is located at a central area of the base plate 31*a*, and makes the shutter holder 31 compact. The gap CL2 is also preferable. Even tough the puncher 41 tends to be overshot, the gap CL2 cancels part of the overshoot, and prevents the tie plate 31*b* from breakage.

The small flexural rigidity, cantilever tie plate 31*b* and gap CL2 are effective against the inclination of the coupling portion 31*c* and shutter plate 32. However, even if a shutter holder does not have one of or two of those features, the remaining two or one feature prevents the shutter plate 32 from the serious inclination.

As described hereinbefore, even though the puncher 41 deeply drives the staple 42 into the white/black key 2*a*/2*b*, the shutter holder 31 keeps the shutter plate 32 perpendicular to the lower surface 2*c* of the white/black key 2*a*/2*b*. A user is assumed to request the manufacturer to retrofit his or her acoustic piano to the composite keyboard musical instrument. The manufacture sends a worker to user's home, and the worker installs the optical sensor system in his or her house. Even tough a suitable jig and/or tool is not carried to the house, the worker can install the optical sensor system, and the complicated calibration, is not required for the optical sensor system.

Second Embodiment

Figure 7A:
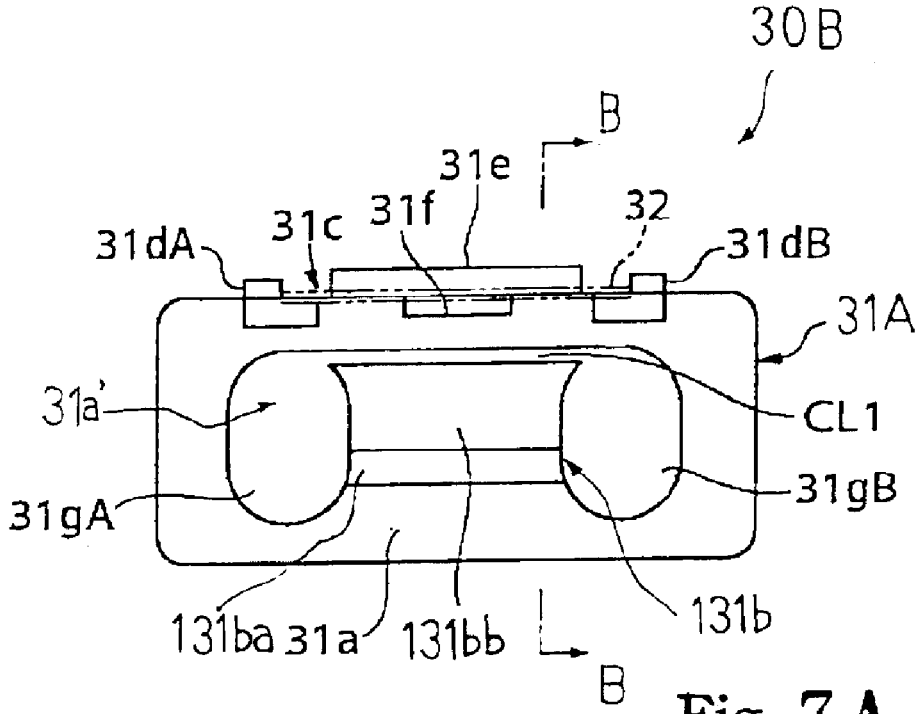
FIG. 7A is a plane view showing another shutter according to the present invention.
Figure 7B:
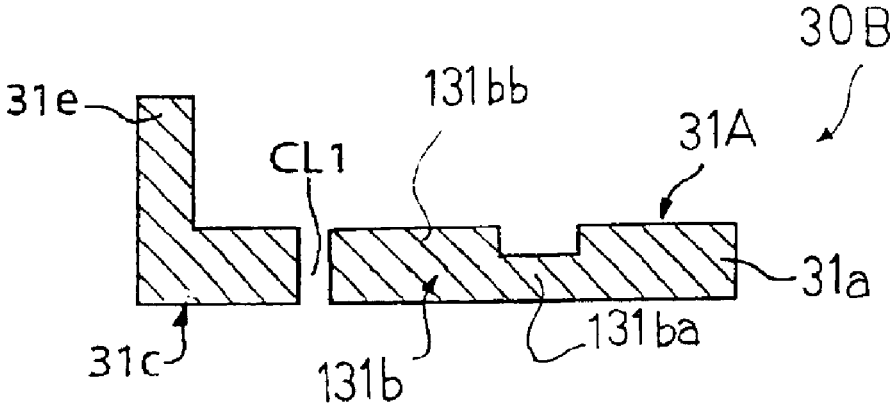
FIG. 7B is a cross sectional view taken along line B—B of FIG. 7A.

Turning to FIGS. 7A and 7B, another shutter 30B embodying the present invention also largely comprises a shutter holder 31A and a shutter plate 32. The shutters 30B form parts of an optical sensor system, and the other system components are similar to those of the optical sensor system 210. The shutter plate 32 is same as that shown in FIG. 3. For this reason, description is hereinafter focused on the shutter holder 31A.

The shutter holder 31A includes a base portion 31*a*, a tie plate 131*b* and a coupling portion 31*c*. The base portion 31*a* and coupling portion 31*c* are similar to those of the shutter holder 31, and no further description is hereinafter incorporated for the sake of simplicity. The tie plate 131*b* is not constant in thickness. Although the boss portion 131*ba* is thinner than the base portion 31*a*, the remaining portion 131*bb* is as thick as the base portion 31*a*. The boss portion 131*ba* has a small value of the second moment of inertia, and, accordingly, the flexural rigidity is smaller in value than that of the base portion. When large bending moment is exerted on the tie plate 131*b* due to the staple deeply driven into the white/black key 2*a*/2*b*, the tie plate 131*b* is widely warped, and absorbs the plastic deformation of the white/black key 2*a*/2*b*. This results in that the tie plate 131*b* prevents the base portion 31*a* from the bending moment. In other words, the base portion 31*a* is less deformed, and keeps the coupling portion 31*c* and, accordingly, the shutter plate 32 perpendicular to the lower surface 2*a* of the white/black key 2*a*/2*b*.

Third Embodiment

Figure 8:
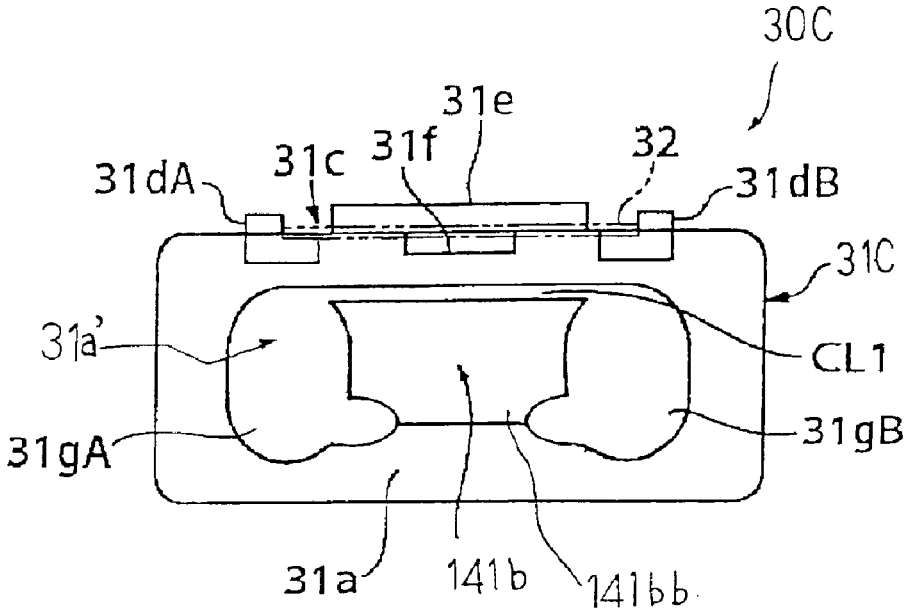
FIG. 8 is a plane view showing yet another shutter according to the present invention.

FIG. 8 shows still another shutter 30C embodying the present invention. The shutter 30C largely comprises a shutter holder 31C and a shutter plate 32. The shutters 30C form parts of an optical sensor system, and the other system components are similar to those of the optical sensor system 210. The shutter plate 32 is same as that shown in FIG. 3. For this reason, description is hereinafter focused on the shutter holder 31C.

The shutter holder 31C includes a base portion 31*a*, a tie plate 141*b* and a coupling portion 31*c*. The base portion 31*a* and coupling portion 31*c* are similar to those of the shutter holder 31, and no further description is hereinafter incorporated for the sake of simplicity. The tie plate 141*b* is constant in thickness. However, the boss portion 141*ba* of the tie plate 141*b* is constricted. This results in that the tie plate 141*b* has a small value of the second moment of inertia at the boss portion. In other words, the tie plate 141*b* has the flexural rigidity small enough to absorb the plastic deformation of the white/black key 2*a*/2*b*. Thus, even if a staple is deeply driven into the white/black key 2*a*/2*b*, the base portion 31*a* is less deformed, and keeps the coupling portion 31*c* and, accordingly, the shutter plate 32 from undesirable inclination.

Although particular embodiments of the present invention have been shown and described, it will be apparent to those skilled in the art that various changes and modifications may be made without departing from the spirit and scope of the present invention.

As described hereinbefore, the shutter holder 31 may be made of metal or alloy. The shutter plate may be non-transparent over the entire surface. In this instance, the amount of light at the light receiving sensor head is drastically varied at the edge of the shutter plate. Moreover, the shutter plate 32 and shutter holder may have a monolithic structure.

The optical sensor system according to the present invention may be used for another sort of movable parts incorporated in the composite keyboard musical instrument such as, for example, hammers 1*d* or pedals. In this instance, the shutters are attached to the hammers 1*d* or foot pedals, and the sensor heads are supported in the vicinity of the trajectories of the hammers 1*d* or pedals.

Moreover, the optical sensor system may be incorporated in another sort of composite keyboard musical instrument such as, for example, an automatic player piano. However, the composite keyboard musical instrument does not set any limit to the application field of the present invention. The optical sensor system according to the present invention may be used in another sort of musical instrument such as, for example, electronic/electric stringed instruments, electric/electronic percussion instruments and electric/electronic wind instruments. The optical sensor system may be applied to some home electric goods and industrial equipment.

The measurements of the tie plate 31*b* are an example against the overshoot of 0.3 millimeter, and are never critical values. If the overshoot is greater than 0.3 millimeter, the tie plate is to be thinner than tie plate 31*b*. Even if the shutter holder 31 is made of synthetic resin softer than the polyacetal or nylon, the time plate may have the measurements different from those of the tie plate 31*b*. On the other hand, if the coupling holder 31*c* is located on the same side as the boss portion of the tie plate 31*b*, the tie plate is to be much thinner than the tie plate 31*b*. Thus, the measurements of the tie plate 31*b* do not set any limit on the technical scope of the present invention.

Figure 9A:
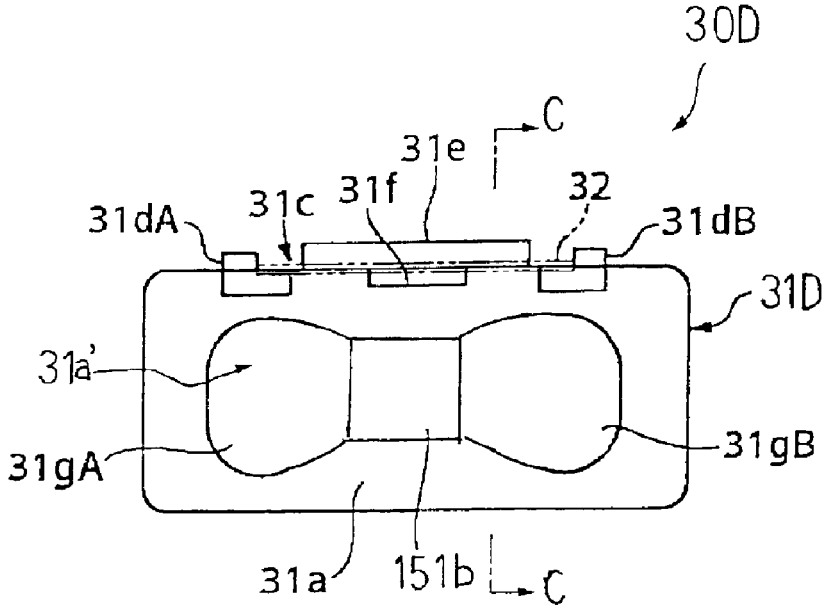
FIG. 9A is a plane view showing still another shutter according to the present invention.
Figure 9B:
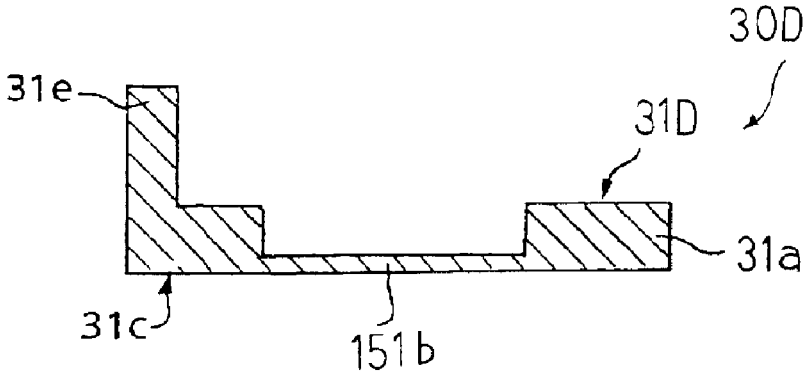
FIG. 9B is a cross sectional view taken along line C—C of FIG. 9A.

Although the tie plates 31*b*/131*b*/141*b* are connected to the base portions 31*a* in the cantilever fashion, yet another tie plate 151*b* of a shutter holder 31D according to the present invention may be connected at both ends thereof to the base portion 31*a* as shown in FIGS. 9A and 9B. In this instance, the tie plate 151*b* is not only thinner but also narrower than the base portion 31*a*, and the flexural rigidity is very small in value. In other words, the tie plate 151*b* is widely deflected, and may be elongated so that the base plate 31*a* keeps the coupling portion 31*c* and, accordingly, the shutter plate 32 perpendicular to the lower surface 2*c* of the white/black key 2*a*/2*b*.

The shutter holders may be secured to the white/black key 2*a*/2*b* by means of nails or screws instead of the staples.

The shutter plate may have a shape different from the rectangular shutter plate 32. A shutter plate may be semicircular or elliptical. The rectangular shutter plate does not set any limit on the technical scope of the present invention.

The second moment of inertial may be gradually varied over the entire length of the tie portion.

Form the aspect of the second approach, the base portion 31*a* may be partially reduced in thickness so as to be widely deformed. Even if the tie portion has a flexural rigidity larger than that of the base portion, the base portion can absorb the deformation of the key.

The component parts of the embodiments are correlated with claim languages as follows. Each of the white/black keys 2*a*/2*b* is corresponding to a moving object. The wood, synthetic resin and metal/alloy are corresponding to a first material, a second material and a third material. The staple 42 serves as a fixing member. As described hereinbefore, nails or screws also serve as the fixing member.

The light emitting devices 212, optical fibers 214, light radiating sensor heads 11*a*, light receiving sensor heads 11*b*, optical fibers 216, light detecting devices 218 as a whole constitute an optical sub-system.

What is claimed is:

1. A shutter secured to a moving object made of a first material, comprising:

a shutter plate crossing a light beam in a motion of said moving object; and a shutter holder including a base portion made of a second material and formed with a hollow space through which a fixing member made of a third material harder than said first and second materials is driven into said moving object for securing said shutter holder to said moving object, a coupling portion formed at a first sub-portion of said base portion and connected to said shutter plate so as to keep said shutter plate in a predetermined attitude with respect to said moving object and a tie portion projecting from a second sub-portion of said base portion into said hollow space, pressed to said moving object by means of said fixing member and having a small flexural rigidity for absorbing a deformation of said moving object due to said fixing member excessively driven thereinto without changing said attitude of said shutter plate.

2. The shutter as set forth in claim 1, in which said tie portion has a cross section, which has a second moment of inertia smaller than that of a cross section of said second sub-portion.

3. The shutter as set forth in claim 2, in which said second moment of inertial is constant over the entire length of said tie portion.

4. The shutter as set forth in claim 3, in which said cross section of said tie portion and said cross section of said second sub-portion are rectangular, and said cross section of said tie portion has a height less than that of said cross section of said second sub-portion.

5. The shutter as set forth in claim 2, in which said second moment of inertia is different between a certain sub-portion of said tie portion closer to said second portion and another sub-portion of said tie portion farther from said second portion.

6. The shutter as set forth in claim 5, in which the cross section of said certain sub-portion has a height less than that of said second portion so that said certain sub-portion has the second moment of inertial less than the second moment of inertia at the cross section of said second portion.

7. The shutter as set forth in claim 1, in which said first portion and said second portion are located on both sides of said hollow space so that said tie portion projects from said second portion toward said first portion.

8. The shutter as set forth in claim 7, in which said tie portion has a cross section, which has a second moment of inertia smaller than that of a cross section of said second sub-portion from which said tie portion projects.

9. The shutter as set forth in claim 7, in which said tie portion is spaced from said first portion in such a manner as to form a gap therebetween.

10. The shutter as set forth in claim 9, in which said tie portion has a cross section, which has a second moment of inertia smaller than that of a cross section of said second sub-portion.

11. The shutter as set forth in claim 1, in which said shutter plate in said predetermined attitude is perpendicular to said moving object.

12. The shutter as set forth in claim 1, in which said tie portion has a lower surface substantially coplanar with a lower surface of said second sub-portion and an upper surface closer to said lower surfaces than an upper surface of said second sub-portion for forming a step between said upper surface of said tie portion and said upper surface of said second sub-portion.

13. The shutter as set forth in claim 12, in which said step is equal to a thickness of said fixing member.

14. The shutter as set forth in claim 1, in which said first material, said second material and said third material are wood, synthetic resin and metal.

15. A shutter secured to a moving object made of a first material, comprising:

a shutter plate crossing a light beam in a motion of said moving object; and a shutter holder including a base portion made of a second material and formed with a hollow space through which a fixing member made of a third material harder than said first and second materials is driven into said moving object for securing said shutter holder to said moving object, a coupling portion formed at a first sub-portion of said base portion and connected to said shutter plate so as to keep said shutter plate in a predetermined attitude with respect to said moving object and a tie portion projecting from a second sub-portion of said base portion into said hollow space in a cantilever fashion and pressed to said moving object by means of said fixing member, said first sub-portion being spaced from said second sub-portion.

16. The shutter as set forth in claim 15, in which said first sub-portion is opposed to said second sub-portion across said hollow space.

17. The shutter as set forth in claim 15, in which said tie portion is smaller in flexural rigidity than said second sub-portion.

18. The shutter as set forth in claim 17, in which said tie portion has a cross section smaller in a second moment of inertia than a cross section of said second sub-portion.

19. The shutter as set forth in claim 18, in which said cross section of said tie portion is smaller in height than said cross section of said second sub-portion so that a step takes place between an upper surface of said tie portion and an upper surface of said second sub-portion.

20. An optical sensor system for converting current positions of moving objects made of a first material to electric signals, comprising:

an optical sub-system producing light beams across trajectories of said moving objects, and converting the amount of light of said light beams to said electric signals;

shutters respectively connected to said moving objects so as to travel on said trajectories together with said moving objects, each of said shutters including a shutter plate crossing associated one of said trajectories and a shutter holder having a base portion made of a second material and formed with a hollow space through which a fixing member made of a third material harder than said first and second materials is driven into said moving object for securing said shutter holder to said moving object, a coupling portion formed at a first sub-portion of said base portion and connected to said shutter plate so as to keep said shutter plate in a predetermined attitude with respect to associated one of said moving objects and a tie portion projecting from a second portion of said base portion into said hollow space, pressed to said associated one of said moving objects by means of said fixing member and having a small flexural rigidity for absorbing a deformation of said associated one of said moving objects due to said fixing member excessively driven thereinto without changing said attitude of said shutter plate.

21. The optical sensor system as set forth in claim 20, in which said optical sub-system monitors said moving objects incorporated in a musical instrument.

22. The optical sensor system as set forth in claim 21, in which said musical instrument is a keyboard musical instrument.

23. The optical sensor system as set forth in claim 20, in which said tie portion is smaller in second moment of inertia than said second sub-portion.

24. An optical sensor system for converting current positions of moving objects made of a first material to electric signals, comprising:

an optical sub-system producing light beams across trajectories of said moving objects, and converting the amount of light of said light beams to said electric signals; and shutters respectively connected to said moving objects so as to travel on said trajectories together with said moving objects, each of said shutters including a shutter plate crossing associated one of said trajectories and a shutter holder having a base portion made of a second material and formed with a hollow space through which a fixing member made of a third material harder than said first and second materials is driven into said moving object for securing said shutter holder to said moving object, a coupling portion formed at a first sub-portion of said base portion and connected to said shutter plate so as to keep said shutter plate in a predetermined attitude with respect to associated one of said moving objects and a tie portion projecting from a second sub-portion of said base portion into said hollow space in a cantilever fashion and pressed to said moving object by means of said fixing member, said first sub-portion being spaced from said second sub-portion.

25. The optical sensor system as set forth in claim 24, in which said optical sub-system monitors said moving objects incorporated in a musical instrument.

26. The optical sensor system as set forth in claim 25, in which said musical instrument is a keyboard musical instrument.

27. The optical sensor system as set forth in claim 24, in which said first sub-portion is opposed to said second sub-portion across said hollow space.

28. The optical sensor system as set forth in claim 24, in which said tie portion is smaller in flexural rigidity than said second sub-portion.

29. A shutter holder for keeping a member stable with respect to an object made of a first material, comprising:

a base portion made of a second material and formed with a hollow space through which a fixing member made of a third material harder than said first and second materials is driven into said object for securing said shutter holder to said object;

a coupling portion formed at a first sub-portion of said base portion and connected to said member so as to keep said member in a predetermined attitude with respect to said object; and a tie portion projecting from a second sub-portion of said base portion into said hollow space, pressed to said object by means of said fixing member and having a small flexural rigidity for absorbing a deformation of said object due to said fixing member excessively driven thereinto without changing said attitude of said member.

30. The shutter holder as set forth in claim 29, in which said tie portion has a cross section, which has a second moment of inertia smaller than that of a cross section of said second sub-portion.

31. The shutter holder as set forth in claim 30, in which said second moment of inertial is constant over the entire length of said tie portion.

32. The shutter holder as set forth in claim 31, in which said cross section of said tie portion and said cross section of said second sub-portion are rectangular, and said cross section of said tic portion has a height less than that of said cross section of said second sub-portion.

33. The shutter holder as set forth in claim 30, in which said second moment of inertia is different between a certain sub-portion of said tie portion closer to said second portion and another sub-portion of said tie portion farther from said second portion.

34. The shutter holder as set forth in claim 33, in which the cross section of said certain sub-portion has a height less than that of said second portion so that said certain sub-portion has the second moment of inertial less than the second moment of inertia at the cross section of said second portion.

35. The shutter holder as set forth in claim 29, in which said first portion and said second portion are located on both sides of said hollow space so that said tie portion projects from said second portion toward said first portion.

36. The shutter holder as set forth in claim 35, in which said tie portion has a cross section, which has a second moment of inertia smaller than that of a cross section of said second sub-portion from which said tie portion projects.

37. The shutter holder as set forth in claim 35, in which said tie portion is spaced from said first portion in such a manner as to form a gap therebetween.

38. The shutter holder as set forth in claim 37, in which said tie portion has a cross section, which has a second moment of inertia smaller than that of a cross section of said second sub-portion.

39. The shutter holder as set forth in claim 29, in which said member in said predetermined attitude is perpendicular to said object.

40. The shutter holder as set forth in claim 29, in which said tie portion has a lower surface substantially coplanar with a lower surface of said second sub-portion and an upper surface closer to said lower surfaces than an upper surface of said second sub-portion for forming a step between said upper surface of said tie portion and said upper surface of said second sub-portion.

41. The shutter holder as set forth in claim 40, in which said step is equal to a thickness of said fixing member.

42. The shutter holder as set forth in claim 29, in which said first material, said second material and said third material are wood, synthetic resin and metal.

43. A shutter holder for keeping a member stable with respect to an object made of a first material, comprising:

a base portion made of a second material and formed with a hollow space through which a fixing member made of a third material harder than said first and second materials is driven into said object for securing said shutter holder to said object;

a coupling portion formed at a first sub-portion of said base portion and connected to said shutter plate so as to keep said shutter plate in a predetermined attitude with respect to said object; and a tie portion projecting from a second sub-portion of said base portion into said hollow space in a cantilever fashion and pressed to said object by means of said fixing member, said first sub-portion being spaced from said second sub-portion.

44. The shutter holder as set forth in claim 43, in which said first sub-portion is opposed to said second sub-portion across said hollow space.

45. The shutter holder as set forth in claim 43, in which said tie portion is smaller in flexural rigidity than said second sub-portion.

46. The shutter holder as set forth in claim 45, in which said tie portion has a cross section smaller in a second moment of inertia than a cross section of said second sub-portion.

47. The shutter holder as set forth in claim 46, in which said cross section of said tie portion is smaller in height than said cross section of said second sub-portion so that a step takes place between an upper surface of said tie portion and an upper surface of said second sub-portion.

* * * * *